US006793746B2

(12) United States Patent
Shimizu et al.

(10) Patent No.: US 6,793,746 B2
(45) Date of Patent: Sep. 21, 2004

(54) STAINLESS STEEL PARTS WITH SUPPRESSED RELEASE OF SULFIDE GAS AND METHOD OF PRODUCING

(75) Inventors: Tetsuya Shimizu, Nagoya (JP); Michio Okabe, Chita (JP)

(73) Assignee: Daido Steel Co., Ltd., Nagoya (JP)

( * ) Notice: Subject to any disclaimer, the term of this patent is extended or adjusted under 35 U.S.C. 154(b) by 0 days.

(21) Appl. No.: 10/134,536

(22) Filed: Apr. 30, 2002

(65) Prior Publication Data

US 2002/0170638 A1 Nov. 21, 2002

Related U.S. Application Data

(63) Continuation of application No. 09/706,801, filed on Nov. 7, 2000, now abandoned.

(30) Foreign Application Priority Data

Nov. 11, 1999 (JP) ..... 11-320809
Nov. 29, 1999 (JP) ..... 11-338256

(51) Int. Cl.[7] ..... C22C 38/42
(52) U.S. Cl. ..... 148/606; 148/325; 420/42
(58) Field of Search ..... 148/325, 606; 420/34, 41, 42, 60, 61, 87

(56) References Cited

U.S. PATENT DOCUMENTS

| | | | |
|---|---|---|---|
| 5,069,870 | A | 12/1991 | Iseda et al. |
| 5,650,024 | A | 7/1997 | Hasegawa et al. |
| 6,033,625 | A | 3/2000 | Nagashima et al. |
| 6,146,475 | A | 11/2000 | Kosa |

FOREIGN PATENT DOCUMENTS

| | | |
|---|---|---|
| JP | 8193249 | 7/1996 |
| JP | 2000169941 | 6/2000 |

*Primary Examiner*—Roy King
*Assistant Examiner*—Harry D Wilkins, III
(74) *Attorney, Agent, or Firm*—Varndell & Varndell, PLLC

(57) ABSTRACT

Disclosed are stainless steel parts, particularly, parts of electronic apparatus, with which troubles caused by so-called "sulfide gas" mainly of $H_2S$ must be avoided. Release of the sulfide gas from the parts is effectively suppressed. The parts have high hardness and corrosion resistance, and can be produced with high finishing accuracy. The stainless steel parts are produced by processing a ferritic or a martensitic stainless steel of a specific alloy composition by forging and/or machining to the shape of the part followed by quenching and tempering, or quenching and tempering followed by machining to the shape of the part, and applying a solution of oxidative acid to the surface of the part so as to dissolve and remove sulfides existing on the surface of the part.

12 Claims, No Drawings

STAINLESS STEEL PARTS WITH SUPPRESSED RELEASE OF SULFIDE GAS AND METHOD OF PRODUCING

CROSS-REFERENCE TO RELATED APPLICATION

This application is a continuation application of U.S. Ser. No. 09/706,801 filed Nov. 7, 2000, now abandoned.

BACKGROUND OF THE INVENTION

1. Field in the Industry

The present invention concerns parts made of free cutting stainless steel, from which release of so-called "sulfide gas", i.e., corrosive gas consisting mainly of $H_2S$, is suppressed to such a level that no practical problem is caused. The invention also concerns a method of producing the parts. The stainless steel here encompasses both ferritic and martensitic stainless steel. The parts according to the invention can be finished by precision machining, and therefore, useful as the parts for electronic apparatus such as rotation axes of hard disk drives to which high hardness and corrosion resistance are required, and the parts installed near the printed circuit substrates.

2. State of the Art

As is well known, Ag, Cu and Al are usually used as the material for contacting points and circuits of electronic apparatus. These metals are easily sulfurized. If the atmosphere contains $H_2S$, the formation of sulfides by S in the atmosphere occurs and the sulfides may cause troubles. Therefore, material such as steel used in an electronic apparatus must be such one that it may not react with moisture in the environment and release substantially no sulfide gas such as $H_2S$. To meet this requirement it is necessary to lower the S-content in the material.

Because the electronic apparatus are generally precision apparatus, very high accuracy is required to dimensions of the parts thereof, and therefore, high machinability is essential to the material. Further, hardness and corrosion resistance are also required.

To date, there has been used, for production of these parts, ferritic and martensitic stainless steel. However, machinability of the conventional steel of this kind is so low that sufficient accuracy may not be realized on the product parts, and that productivity of processing is low. Steels such as SUS 430F (ferritic), SUS416 and SUS420F (martensitic) exhibit improved machinability by addition of S. These free cutting steels do not fit for use due to release of the sulfide gas. There has been, therefore, strong demand for a stainless steel which releases no sulfide gas and has high machinability.

A proposal to meet this demand is to lower the Mn/S ratio in the steel so that the sulfides formed may be less soluble (for example, Japanese Patent Disclosure Hei.10-237603). In this steel the S-content is controlled to a suitable low level. The machinability decreased by lowering the S-content is compensated by addition of other free cutting elements such as Se and the like. The drawback of this countermeasure to the problem is, instead of the suppressed release of the sulfide gas given by the decreased Mn/S ratio, processability of the alloy is low and the production cost is high.

SUMMARY OF THE INVENTION

The object of the present invention is to improve the parts made of ferritic or martensitic stainless steel, particularly, the parts of electronic apparatus, in which troubles caused by the sulfide gas should be avoided, and to provide such parts with suppressed release of sulfide gas to such extent that no practical problem is caused. The parts have high hardness and corrosion resistance, as well as high finishing accuracy.

DETAILED EXPLANATION OF THE PREFERRED EMBODIMENTS

As noted above, the stainless steel parts of the present invention with suppressed release of sulfide gas include the parts made of both ferritic and martensitic stainless steel.

The ferritic stainless steel consists essentially of, as the basic alloy composition, at percent by weight, C: up to 0.12%, Si: 0.05–1.00%, Mn: 0.5–2.5%, S: 0.02–0.25%, Cu: 0.01–0.50%, Ni: 0.01–0.50%, Cr: 15.0–25.0%, N: up to 0.05% and O: 0.005–0.040%, and the balance of Fe, provided that P: 0.04% or less and the ratio Mn/S is 5.0 or higher. The steel is processed to blanks having the shape of the parts, and the blanks are treated with a solution of oxidative acid to dissolve out sulfides existing on the surfaces of the blanks.

The martensitic stainless steel consists essentially of, as the basic alloy composition, also by weight percent, C: 0.05–0.65%, Si: 0.01–1.00%, Mn: 0.5–2.5%, S: more than 0.010%–0.25%, Cu: 0.01–0.50%, Ni: 0.01–0.50%, Cr: 10.0–16.0%, N: 0.01–0.15% and O: 0.004–0.030%, and the balance of Fe, provided that P: 0.04% or less and the ratio Mn/S is 8.5 or higher. The steel is also processed to blanks having the shape of the parts, and the blanks are treated with a solution of oxidative acid to dissolve out sulfides existing on the surfaces of the blanks.

The stainless steel used as the material for the parts with suppressed release of sulfide gas may contain, in both ferritic and martensitic, in addition to the above described basic alloy components, one or more of the elements belonging to the following groups I to IV.

To the ferritic stainless steel,

Group I: one or two of Mo: up to 3.0% and W: up to 3.0%;

Group II: one or more of Se: up to 0.50%, Pb: up to 0.30%, Bi: up to 0.20% and Te: up to 0.10%;

Group III: one or more of B, Ca, Mg and REM: 0.0005–0.010%; and

Group IV: one or more of Nb, V, Ti, Zr, Hf and Ta: 0.03–0.50%.

To the martensitic stainless steel,

Group I: one or two of Mo: up to 2.0% and W: up to 2.0%;

Group II: one or more of Se: up to 0.50%, Pb: up to 0.30%, Bi: up to 0.20% and Te: up to 0.10%;

Group III: one or more of B, Ca, Mg and REM: up to 0.0005%; and

Group IV: one or more of Nb, V, Ti, Zr, Hf and Ta: 0.03–0.50%.

The method of producing the stainless steel parts of the present invention comprises:

processing a ferritic or a martensitic stainless steel of any alloy composition defined above by forging and/or machining to the shape of the part, followed by quenching and tempering; or quenching and tempering, followed by machining to the shape of the parts; and applying a solution of oxidative acid to the surfaces of the parts so as to dissolve and remove sulfides existing on the surfaces of the parts.

The reason why the alloy compositions of the ferritic and martensitic stainless steel are decided as noted above will be explained below. Alloying elements in which the effects are common in the two kinds of stainless steels and the ranges of addition amounts are the same or similar are explained in the lumps.

C: up to 0.12% for ferritic stainless steel, and 0.05–0.65% for martensitic stainless steel In the ferritic stainless steel carbon combines with chromium to precipitate carbides, which lowers corrosion resistance. Carbon also increases hardness of the matrix as a solution-strengthening element to impair machinability of the steel. Therefore, it is preferable to decrease the carbon content as low as possible. In view of the technological limit in steel making the above upper limit, 0.12%, was decided as the limit at which there is no significant increase in costs and little influence on the steel properties. Preferably, carbon content is less than the lower limit of 0.03%.

For the martensitic stainless steel, carbon is essential to ensure the hardness. However, carbon is undesirable in regard to the corrosion resistance. It is advisable to add, with expectation of hardness on nitrogen by adding such a large amount of nitrogen that is possible in ordinary steel making technology, suitable amount of carbon which may give a desired hardness. From this point of view, the lower limit, 0.05%, is the necessary amount for ensuring the hardness. The upper limit, 0.65%, is decided in view of the facts that increase in hardness saturates at a higher addition amount and that, if the carbon content exceeds this limit, too large primary carbide particles occur and damage processability such as machinability after annealing.

Si: for the ferritic stainless steel 0.05–1.00% for the martensitic stainless steel 0.01–1.00%

Si is used as a deoxidizing agent in steel making, and for this purpose, it is necessary to add Si of the amount of the lower limit, 0.01%, or higher, preferably, 0.05% or higher. However, Si enhances formation of intermetallic compounds and increases strength of the matrix to decrease machinability of the stainless steel. Therefore, large amount of addition is not recommended. Thus, 1.0% is set as the upper limit. Si-content is preferably up to 0.5%, more preferably, 0.3% or less.

Mn: 0.5–2.5%

Mn is also a deoxidizing agent. It is added, to both ferritic and martensitic stainless steel, in an amount of at least 0.5%. A lower amount causes increase of producing costs. In the steel Mn combines with S to form MnS, which improves hot workability of the steel. Mn-content of 0.5% or higher will be useful for compensating decrease of hot workability caused by addition of S. On the other hand, a large amount of Mn lowers corrosion resistance of the steel, and thus, addition amount may be limited to 2.5% or less.

Addition of Mn must be, for the purpose of ensuring necessary machinability of the steels, in such amount that makes the ratio Mn/S 5.0 or more, preferably, 8.5 or more, for the ferritic stainless steel, and 8.5 or more, preferably, 10 or more for martensitic stainless steel.

S: for the ferritic stainless steel 0.02–0.25%, and for the martensitic stainless steel more than 0.01%–0.25%

In order to ensure machinability of the steel S is added in an amount, as noted above, 0.02% or more for the ferritic stainless steel and in an amount exceeding 0.010% for the martensitic stainless steel. A preferable amount in the latter is 0.040% or more. Too much S causes release of the sulfide gas. However, in the present invention, sulfides on the surface of the parts will be removed by dissolution, and therefore, such a high S-content that gives high machinability can be chosen. Anyway, however, an S-content exceeding 0.25% makes it difficult to suppress release of the sulfide gas, and brings about harmful influence such as embrittlement of the steel and decrease of corrosion resistance.

Cu: 0.01–0.50%

Ni: 0.01–0.50%

Both Cu and Ni enhance corrosion resistance of the steel, particularly, in the reductive acid environment. To obtain this effect both Cu and Ni of at least 0.01% are added. Too much addition of them impairs phase stability of the steel and causes hardness 0.50%, is set for the addition amounts of these elements.

Cr: for the ferritic stainless steel 15.0–25.0%, preferably, 18.0–24.0%, and for the martensitic stainless steel 10.0–16.0%, preferably, 11.5–13.0%

Cr is an important element which supports corrosion resistance of the steel. For the ferritic stainless steel 15.0% or more, preferably, 18.0% or more of Cr is added. For the martensitic stainless steel it is necessary to add at least 10.0% or more. Excess addition will, however, lowers the phase stability and hot workability of the steel. Thus, addition of Cr is limited to be, for the ferritic, up to 25.0%, preferably, up to 24,0%, and for the martensitic, up to 16.0%, preferably, up to 13.0%.

N: for the ferritic stainless steel up to 0.05%, and for the martensitic stainless steel 0.01–0.15%

N is, for the ferritic stainless steel, a solution-strengthening element, which increases hardness of the matrix and, as the result, decreases machinamibility of the steel. It is, therefore, preferable that the N-content is as low as possible. In view of the steel producing costs, the upper limit, 0.05%, is set as the allowable limit.

On the other hand, for the martensitic stainless steel, N is useful, as explained above in regard to C-content, for ensuring the hardness at alloy compositions in which C-content is low. Thus, at least 0.01% of N is added. N also improves corrosion resistance of the steel. Addition of large amount of N not only makes the steel making costs inappropriately high, but also impairs soundness of steel ingots at casting. The upper limit, 0.15%, is thus set.

O: 0.004–0.040%, preferably, 0.004–0.030%

For the purpose of increasing machinability of the stainless steel O is added, for both the ferritic and the martensitic stainless steel, in the amount of at least 0.004%, which is the common lower limit. Excess O forms oxides of excess amount to damage cleanliness of the steel, which rather results in decreased machinability. The addition amount must be chosen in the range up to the upper limit, 0.040%, preferably, up to 0.030%.

P: up to 0.04%

P is an undesirable impurity, which segregates at the crystal boundaries to impair properties of the steel, and therefore, the content should be as low as possible. The above limit, 0.04%, is the allowable limit. Because production of extremely low phosphor steel is expensive, the P-content should be decided at the balance of the characteristic properties required for the parts and the production costs.

Ratio Mn/S: for the ferritic stainless steel 5.0 or more, preferably, 8.5 or more, and for the martensitic stainless steel 8.5 or more, preferably, 10 or more Because, as noted above, a low Mn/S ratio makes the processability of the steel low, the ratio must be 5.0 or more, preferably, 8.5 or more for the ferritic stainless steel and 8.5 or more, preferably, 10 or more for the martensitic stainless steel so that good processability may be avilable. If the Mn/S ratio is too small, a portion of Mn in MnS is replaced by Cr to form sulfides which are relatively less soluble in acid solution. If the Mn/S ratio is high, the sulfides are those easily soluble in acid solution. In the present invention the part blanks obtained by machining are treated with acid to dissolve and remove the sulfides. The high Mn/S ratio makes it possible to completely remove the sulfides from the surfaces of the parts.

Effects of the optionally added elements as well as the reasons for limiting the ranges of alloy compositions thereof are as follows.

Group I: one or two of Mo and W

Both Mo and W increase corrosion resistance. Too much addition impairs hot workability and increases the production costs. Thus, amounts of these elements should be chosen in view of the balance of merits and demerits of addition in a suitable range. The upper limits of addition are, 2.0% for the ferritic stainless steel, and 3,0% for the martensitic stainless steel.

Group II: one or more of Se, Pb, Bi and Te

In case where a higher machinability is sought, the element or elements of this group are added. Addition improves machinability, but instead, lowers hot workability. The above upper limits, Se: up to 0.50%, Pb: up to 0.30%, Bi: up to 0.20% and Te: up to 0.10% are thus decided. Preferable ranges of addition where the machinability improving effect is distinct and the decrease in hot workability is not significant are as follows. Se: 0.2–0.4%, Pb: 0.12–0.25%, Bi: 0.07–0.20%, Te: 0.02–0.05%.

Group III: one or more of B, Ca, Mg and REM

These elements improve hot workability and machinability. These effects are appreciable at a very low addition amount. Addition in a large amount will be harmful to cleanliness of the steel. Suitable addition amount for the ferritic stainless steel is 0.0005–0.01% and for the martensitic stainless steel, up to 0.0005%.

Group IV: one or more of Nb, V, Ti, Zr, Hf and Ta

Elements of this group enhance toughness of the steel by making the crystal grains minute and by solution-strengthening. On the other hand, excess addition causes formation of carbides and nitrides, resulting in lowered cleanliness. The range of 0.03–0.50% is set from this point of view.

The treatment of immersing blanks of the parts may be conveniently realized as passivation treatment, which is often employed as a kind of surface treatment of metal articles. The passivation treatment may be carried out by an ordinary manner where the parts are immersed at a somewhat elevated temperature in, for example, a nitric acid solution containing potassium bichromate. As the result of dissolution and removal of the sulfides existing on the surfaces of the parts, there no longer exists the sulfides which may react the moisture in the environment of the parts when used to release $H_2S$. Release of the sulfide gas is thus suppressed.

The present invention makes it is possible to produce the products of the shaped parts of high finishing accuracy by using a ferritic or martensitic stainless steel having a high Mn/S ratio and suitable amount of S as the material and by ensuring high workability at forging and machining. By the final step, acid treatment of the parts to dissolve and remove the sulfides existing on the surfaces of the part blanks, the parts with suppressed release of the sulfide gas can be obtained.

By using a ferritic or a martensitic stainess steel which contains, in addition to the basic alloy components, one or more of the optional elements as desired, it is possible to enjoy the benefits of improved characteristic properties of the steel given by the respective additional element or elements.

The method of producing the parts of the present invention involves no particular factor to increase producing costs, and therefore, can provide less expensive parts. The parts according to the invention are particularly suitable for the parts of electronic apparatus, at which the trouble caused by the sulfide gas must be avoided.

EXAMPLES

The testing method employed in the following Examples are as follows.

Hot Workability

Scratches of the hot forged products are observed and evaluated to the following five classes.

No scratch A>B>C>D>E Big Significant scratch, forging impossible

Turning Test

Test Piece: diameter 60 mm, outer surface is lathed

Tool: Cermet, cutting speed: 120 m/min.

Feed Rate: 0.05 mm Cutting Depth: 0.1 mm

Cutting Oil: water soluble

Criteria: flank abrasion after 60 min. cutting ($\mu$m)

Drilling Test

| | |
|---|---|
| Tool: SKH9 $\phi$5 mm | Feed Rate: 0.07 mm |
| Depth of Hole: 15 mm | Cutting oil: no |

Criteria: cutting speed (m/min.) at which tool life (no further drilling) is 5000 mm Sulfide Gas Releasing Test Two test pieces of length 25 mm, width 15 mm and thickness 3 mm were cut out from one sample of diameter 20 mm, and whole the surfaces were polished with #400 emery. The test pieces were then passivated under the following conditions.

Immersion in oxidative acid: aqueous solution of 30% nitric acid +2% potassium bichromate, 50° C., 1 hour Ultrasonic Cleaning: in pure water, 5 min., repeated three times, followed by drying These test pieces were contained in a container together with pure water 0.05 cc and Ag-foils of 10 mm long and 5 mm wide. The container was kept at 85° C. for 20 hours and then, color change of the Ag-foils (extent of $Ag_2S$ formation) was observed and ranked in the following five classes.

No color change A>B>C>D>E Remarkable color change (large amount of the sulfide gas released)

Wet Test

Rods of diameter 20 mm were machined to form each three test pieces of diameter 10 mm and length 50 mm per one sample, and the both faces of the test pieces were polished with #320 emery. The test pieces were exposed to an atmosphere of RH 90% at 40° C. for 120 hours. Occurrence of rust was observed and evaluated to the following five classes.

A: no stain B: a few stains C: many stains

D: small amount of rust (areal percentage not more than 10%)

E: large amount of rust (areal percentage more than 10%)

Salt Water Cycle Test

As noted in regard to the wet test, each three test pieces of diameter 10 mm and length 50 mm were prepared from one sample of diameter 20 mm, and the both faces of the test pieces were polished with #320 emery. The test pieces were treated by the same way as done prior to the above described sulfide gas releasing test. The treated test pieces were subjected three times to the cycle of immersing in 5% NaCl aqueous solution at 35° C. for six hours, and then exposing to an environment of RH 30% at 50° C. for 18 hours. Occurrence of rust was observed and evaluated into the six classes from A (no stain) to F (rust over the whole surface).

Example 1

Parts of Ferritic Stainless Steel

Alloys of the composition shown in Tables 1 and 2 were produced in an atmospheric induction furnace, and cast into ingots weighing 50 kg. Control Example 1 is equivalent to SUS430F.

The ingots were hot-forged to form steel rods of diameters 60 mm or 20 mm, and the rods were subjected to annealing by heating to 750–820° C. and air cooling. All the samples were tested by the testing methods as described above. The test results are shown in Table 3 (Invention) and Table 4 (Controls).

TABLE 1

(Invention)

| No. | C | Si | Mn | P | S | Cu | Ni | Cr | N | O | Others | Mn/S |
|---|---|---|---|---|---|---|---|---|---|---|---|---|
| 1 | 0.02 | 0.19 | 1.96 | 0.025 | 0.23 | 0.04 | 0.15 | 19.5 | 0.01 | 0.0129 | — | 8.5 |
| 2 | 0.01 | 0.22 | 1.46 | 0.024 | 0.16 | 0.02 | 0.05 | 20.1 | 0.02 | 0.0143 | Mo 0.5 Pb 0.14 | 9.1 |
| 3 | 0.01 | 0.15 | 0.95 | 0.031 | 0.09 | 0.09 | 0.06 | 19.3 | 0.01 | 0.0099 | Pb 0.21 Se 0.15 | 10.6 |
| 4 | 0.03 | 0.24 | 1.15 | 0.019 | 0.07 | 0.05 | 0.31 | 18.2 | 0.02 | 0.0169 | Mo 1.2 Se 0.268 | 16.4 |
| 5 | 0.005 | 0.11 | 0.98 | 0.013 | 0.19 | 0.04 | 0.09 | 22.2 | 0.02 | 0.0233 | Pb 0.15 Mo 1.2 Te 0.02 | 5.2 |
| 6 | 0.01 | 0.28 | 1.24 | 0.039 | 0.14 | 0.06 | 0.22 | 19.5 | 0.03 | 0.0211 | Mo 2.7 Pb 0.19 | 8.9 |
| 7 | 0.05 | 0.38 | 1.19 | 0.021 | 0.23 | 0.03 | 0.33 | 19.3 | 0.01 | 0.0072 | — | 5.2 |
| 8 | 0.02 | 0.28 | 1.44 | 0.024 | 0.16 | 0.05 | 0.21 | 20.4 | 0.01 | 0.0119 | Pb 0.19 Te 0.03 | 9.0 |
| 9 | 0.01 | 0.31 | 1.05 | 0.011 | 0.12 | 0.04 | 0.11 | 19.3 | 0.02 | 0.0135 | Bi 0.07 | 8.8 |
| 10 | 0.01 | 0.22 | 0.77 | 0.022 | 0.09 | 0.05 | 0.05 | 19.9 | 0.01 | 0.0154 | Se 0.11 Mo 0.4 Te 0.03 | 8.6 |
| 11 | 0.01 | 0.28 | 1.61 | 0.025 | 0.17 | 0.04 | 0.09 | 19.4 | 0.01 | 0.0146 | Mo 0.3 B 0.0051 Bi 0.03 | 9.5 |
| 12 | 0.05 | 0.12 | 2.21 | 0.030 | 0.13 | 0.06 | 0.03 | 20.9 | 0.02 | 0.0198 | W 0.9 Pb 0.15 Mm 0.0021 | 17.0 |
| 13 | 0.01 | 0.08 | 1.33 | 0.018 | 0.11 | 0.04 | 0.05 | 19.0 | 0.02 | 0.0323 | Se 0.20 B 0.0013 V 0.13 | 12.1 |
| 14 | 0.02 | 0.27 | 1.28 | 0.024 | 0.13 | 0.03 | 0.05 | 20.3 | 0.03 | 0.0133 | Pb 0.12 Ca 0.0033 Nb 0.05 | 9.9 |
| 15 | 0.01 | 0.11 | 1.23 | 0.026 | 0.13 | 0.25 | 0.05 | 19.2 | 0.02 | 0.0155 | Pb 0.09 Mo 1.8 Mg 0.0016 | 9.5 |

TABLE 2

(Controls)

| No. | C | Si | Mn | P | S | Cu | Ni | Cr | N | O | Others | Mn/S |
|---|---|---|---|---|---|---|---|---|---|---|---|---|
| 16 | 0.04 | 0.42 | 0.88 | 0.029 | 0.31 | 0.04 | 0.12 | 16.4 | 0.03 | 0.0184 | — | 2.8 |
| 17 | 0.01 | 0.38 | 0.28 | 0.028 | 0.32 | 0.06 | 0.04 | 19.1 | 0.02 | 0.0285 | Mo 0.4 Pb 0.20 | 0.88 |
| 18 | 0.02 | 0.22 | 0.94 | 0.023 | 0.26 | 0.07 | 0.21 | 20.6 | 0.03 | 0.0121 | Mo 1.8 Pb 0.16 | 3.6 |
| 19 | 0.01 | 0.37 | 1.12 | 0.027 | 0.28 | 0.02 | 0.11 | 18.9 | 0.02 | 0.0155 | — | 4.0 |
| 20 | 0.02 | 0.33 | 1.07 | 0.019 | 0.29 | 0.03 | 0.09 | 18.3 | 0.03 | 0.0111 | Mo 0.2 | 3.7 |
| 21 | 0.01 | 0.29 | 0.62 | 0.026 | 0.22 | 0.05 | 0.08 | 20.1 | 0.01 | 0.0162 | — | 2.8 |

TABLE 3

(Invention)

| No. | Hardness after Annealing (HV) | Hot Workability | Turning Test (μm) | Drilling Test m/min. | Sulfide Gas Releasing Test | Wet Test | Salt Water Cycle Test |
|---|---|---|---|---|---|---|---|
| 1 | 147 | A | 350 | 65 | B | A | B |
| 2 | 153 | A | 290 | 72.5 | B | A | B |
| 3 | 149 | A | 250 | 80 | A | A | B |
| 4 | 167 | A | 295 | 72.5 | A | A | B |
| 5 | 141 | A | 255 | 77.5 | B | A | A |
| 6 | 162 | A | 285 | 75 | B | A | A |
| 7 | 163 | A | 340 | 67.5 | C | A | B |
| 8 | 155 | A | 245 | 82.5 | B | A | B |
| 9 | 149 | A | 315 | 70 | B | A | B |
| 10 | 151 | A | 375 | 60 | B | A | B |

TABLE 3-continued (Invention)

| No. | Hardness after Annealing (HV) | Hot Workability | Turning Test (μm) | Drilling Test m/min. | Sulfide Gas Releasing Test | Wet Test | Salt Water Cycle Test |
|---|---|---|---|---|---|---|---|
| 11 | 148 | A | 360 | 62.5 | B | A | B |
| 12 | 166 | A | 295 | 72.5 | A | A | A |
| 13 | 150 | A | 285 | 72.5 | A | A | B |
| 14 | 147 | A | 295 | 75 | B | A | B |
| 15 | 140 | A | 330 | 70 | B | A | A |

TABLE 4

(Control)

| No. | Hardness after Annealing (HV) | Hot Workability | Turning Test (μm) | Drilling Test m/min. | Sulfide Gas Releasing Test | Wet Test | Salt Water Cycle Test |
|---|---|---|---|---|---|---|---|
| 16 | 152 | A | 405 | 55 | E | C | D |
| 17 | 153 | C | 285 | 75 | B | A | B |
| 18 | 161 | B | 290 | 75 | D | A | A |
| 19 | 153 | B | 290 | 75 | D | A | A |
| 20 | 148 | B | 340 | 62.5 | E | A | B |
| 21 | 147 | C | 370 | 60 | E | A | B |

EXAMPLE 2

Parts of Martensitic Stainless Steel

Alloys of the composition shown in Tables 5 and 6 were produced in an atmospheric induction furnace, and cast into ingots weighing 50 kg. No.45 steel is equivalent to SUS410, and No.46 steel, SUS416.

The ingots were hot-forged to form steel rods of diameters 60 mm or 20 mm, and the rods were annealed by heating to 750° C. and air-cooling. All the samples as annealed were subjected to boring test and drilling test.

Then, the samples of diameter 20 mm were quenched and tempered by being heated to 1000° C. for 30 minutes and oil-quenching, followed by heating to 180° C. for 1 hour and air cooling. Hardness of the thus treated samples was measured and averages of 5 samples were recorded.

The heat-treated samples of diameter 20 mm were subjected to passivation treatment and sulfide gas releasing test and humid test.

The test results are shown in Table 7 (Invention) and Table 8 (Controls).

TABLE 5

(Invention)

| No. | C | Si | Mn | P | S | Cu | Ni | Cr | N | O | Others | Mn/S |
|---|---|---|---|---|---|---|---|---|---|---|---|---|
| 31 | 0.12 | 0.21 | 2.21 | 0.024 | 0.21 | 0.02 | 0.15 | 12.8 | 0.03 | 0.0053 | — | 10.5 |
| 32 | 0.24 | 0.18 | 1.95 | 0.018 | 0.17 | 0.05 | 0.21 | 12.4 | 0.02 | 0.0095 | — | 11.5 |
| 33 | 0.47 | 0.05 | 2.14 | 0.020 | 0.16 | 0.09 | 0.12 | 12.7 | 0.04 | 0.0077 | — | 13.4 |
| 34 | 0.14 | 0.52 | 1.77 | 0.031 | 0.09 | 0.19 | 0.32 | 12.4 | 0.07 | 0.0058 | Se 0.26 Pb 0.18 | 19.7 |
| 35 | 0.09 | 0.18 | 1.56 | 0.019 | 0.09 | 0.14 | 0.21 | 13.1 | 0.06 | 0.0102 | Pb 0.24 Te 0.02 | 17.3 |
| 36 | 0.14 | 0.26 | 1.08 | 0.027 | 0.05 | 0.06 | 0.31 | 12.6 | 0.02 | 0.0088 | Mo 0.48 Se 0.25 | 21.6 |
| 37 | 0.08 | 0.08 | 1.93 | 0.033 | 0.14 | 0.02 | 0.03 | 11.2 | 0.07 | 0.0059 | W 1.5 Se 0.28 Pb 0.16 | 13.8 |
| 38 | 0.15 | 0.30 | 0.95 | 0.015 | 0.07 | 0.08 | 0.27 | 13.2 | 0.03 | 0.0074 | Pb 0.17 Se 0.19 B 0.0022 | 13.6 |
| 39 | 0.16 | 0.25 | 1.31 | 0.022 | 0.02 | 0.11 | 0.25 | 12.7 | 0.05 | 0.0162 | Pb 0.25 Te 0.04 La + Ce 0.0023 | 65.5 |
| 40 | 0.24 | 0.22 | 1.21 | 0.029 | 0.13 | 0.03 | 0.29 | 12.2 | 0.04 | 0.0055 | Se 0.15 Nb 0.21 Ca 0.0019 | 9.3 |
| 41 | 0.35 | 0.16 | 0.99 | 0.030 | 0.06 | 0.08 | 0.38 | 13.3 | 0.13 | 0.0108 | Pb 0.19 Mg 0.0015 | 16.5 |
| 42 | 0.15 | 0.31 | 1.05 | 0.012 | 0.09 | 0.15 | 0.18 | 12.7 | 0.06 | 0.0067 | Pb 0.18 V 0.16 Zr 0.13 | 11.7 |
| 43 | 0.18 | 0.19 | 0.69 | 0.008 | 0.03 | 0.22 | 0.22 | 14.1 | 0.02 | 0.0088 | Mo 0.40 Bi 0.15 Hf 0.18 | 23.0 |
| 44 | 0.33 | 0.20 | 1.25 | 0.026 | 0.07 | 0.08 | 0.17 | 11.9 | 0.03 | 0.0054 | Se 0.32 Ti 0.24 Ta 0.17 | 17.9 |

TABLE 6

(Controls)

| No. | C | Si | Mn | P | S | Cu | Ni | Cr | N | O | Others | Mn/S |
|---|---|---|---|---|---|---|---|---|---|---|---|---|
| 45 | 0.13 | 0.56 | 0.63 | 0.027 | 0.02 | 0.06 | 0.17 | 12.2 | 0.02 | 0.0051 | — | 31.5 |
| 46 | 0.12 | 0.44 | 1.12 | 0.032 | 0.21 | 0.03 | 0.11 | 12.5 | 0.02 | 0.0069 | Mo 0.3 | 5.3 |
| 47 | 0.14 | 0.28 | 1.24 | 0.021 | 0.16 | 0.08 | 0.24 | 12.6 | 0.05 | 0.0111 | — | 7.8 |
| 48 | 0.21 | 0.44 | 0.96 | 0.021 | 0.15 | 0.02 | 0.33 | 13.1 | 0.03 | 0.0049 | Pb 0.19 | 6.4 |
| 49 | 0.45 | 0.23 | 0.88 | 0.033 | 0.24 | 0.12 | 0.08 | 11.2 | 0.04 | 0.0093 | Mo 1.2 Se 0.12 | 3.7 |
| 50 | 0.31 | 0.52 | 0.89 | 0.024 | 0.005 | 0.09 | 0.22 | 13.5 | 0.06 | 0.0121 | — | 178.0 |
| 51 | 0.16 | 0.33 | 0.63 | 0.018 | 0.005 | 0.15 | 0.35 | 6.2 | 0.01 | 0.0071 | — | 126.0 |

TABLE 7

(Invention)

| No. | Turning Test μm | Drilling Test m/min. | Hardness HRC | Sulfide Gas Releasing Test | Wet Test |
|---|---|---|---|---|---|
| 31 | 330 | 70 | 36 | B | B |
| 32 | 340 | 67.5 | 46 | B | B |
| 33 | 350 | 65 | 59 | B | B |
| 34 | 290 | 77.5 | 41 | A | B |
| 35 | 305 | 75 | 37 | A | B |
| 36 | 330 | 67.5 | 37 | A | A |
| 37 | 275 | 82.5 | 36 | B | B |
| 38 | 285 | 80 | 39 | B | A |
| 39 | 320 | 70 | 42 | A | A |
| 40 | 340 | 65 | 47 | C | B |
| 41 | 335 | 70 | 57 | A | A |
| 42 | 320 | 70 | 42 | B | B |
| 43 | 330 | 67.5 | 41 | A | A |
| 44 | 315 | 70 | 54 | A | B |

TABLE 8

(Controls)

| No. | Turning Test μm | Drilling Test m/min. | Hardness HRC | Sulfide Gas Releasing Test | Wet Test |
|---|---|---|---|---|---|
| 45 | >500 | <40 | 37 | A | B |
| 46 | 335 | 67.5 | 36 | E | C |
| 47 | 350 | 72.5 | 39 | D | B |
| 48 | 290 | 80 | 44 | D | B |
| 49 | 335 | 67.5 | 58 | E | B |
| 50 | >500 | <40 | 55 | A | A |
| 51 | >500 | <40 | 34 | A | B |

We claim:

1. A stainless steel part with suppressed release of sulfide gas, produced by processing a ferritic stainless steel consisting essentially of, by weight percent, C: up to 0.12%, Si: 0.05–1.00%, Mn: 0.5–2.50, S: 0.02–0.250, Cu: 0.01–0.500, Ni: 0.01–0.50%, Cr: 15.0–25.0%, N: up to 0.05% and 0: 0.005–0.040%, and the balance of Fe, provided that P: 0.04% or less and the ratio Mn/S being 8.5 or higher, to the shape of a part, treating the shaped part with a solution of oxidative acid to dissolve out sulfides existing on the surface of the part.

2. The part with suppressed release of sulfide gas according to claim 1, wherein the ferritic stainless steel contains, in additon to the alloy components set forth in claim 1, one or two of Mo: up to 3.0% and W: up to 3.0%.

3. The part with suppressed release of sulfide gas according to claim 1, wherein the ferritic stainless steel contains, in additon to the alloy components set forth in claim 1, one or more of Se: up to 0.50%, Pb: up to 0.30%, Bi: up to 0.20% and Te: up to 0.1%.

4. The part with suppressed release of sulfide gas according to claim 1, wherein the ferritic stainless steel contains, in additon to the alloy components set forth in claim 1, 0.0005–0.010% of one or more members selected from the group consisting of B, Ca, Mg and REM.

5. The part with suppressed release of sulfide gas according to claim 1, wherein the ferritic stainless steel contains, in addition to the alloy components set forth in claim 1, 0.03–0.050% of one or more members selected from the group consisting of Nb, V. Ti, Zr, Hf and Ta.

6. A method of producing a part with suppressed release of sulfide gas, which comprises: processing a ferritic stainless steel of the alloy composition defined by any one of claims 1–5 by forging and/or machining to the shape of the part followed by quenching and tempering, or quenching and tempering followed by machining to the shape of the part, and applying a solution of oxidative acid to the surface of the part so as to dissolve and remove sulfides existing on the surface of the part.

7. A stainless steel part with suppressed release of sulfide gas, produced by processing a martensitic stainless steel consisting essentially of, by weight percent, C: 0.05–0.65%, Si: 0.01–1.00%, Mn: 0.5–2.5%, S: 0.010%–0.25%, Cu: 0.01–0.50%, Ni: 0.01–0.50%, Cr: 10.0–16.0%, N: 0.01–0.15% and O: 0.004–0.030%, and the balance of Fe, provided that P: 0.04% or less and the ratio Mn/S being 8.5 or higher, to the shape of a part, treating the shaped part with a solution of oxidative acid to dissolve out sulfides existing on the surface of the part.

8. The part with suppressed release of sulfide gas according to claim 7, wherein the martensitic stainless steel contains, in additon to the alloy components set forth in claim 7, one or two of Mo: up to 2.0% and W: up to 2.0%.

9. The part with suppressed release of sulfide gas according to claim 7, wherein the martensitic stainless steel contains, in additon to the alloy components set forth in claim 7, one or more of Se: up to 0.50%, Pb: up to 0.30%, Bi: up to 0.20% and Te: up to 0.10%.

10. The part with suppressed release of sulfide gas according to claim 7, wherein the martensitic stainless steel contains, in addition to the alloy components set forth in claim 7, up to 0.0005% of one or more members selected from the group consisting of B, Ca, Mg and REM.

11. The part with suppressed release of sulfide gas according to claim 7, wherein the martensitic stainless steel contains, in addition to the alloy components set forth in claim 7, 0.03–0.50% of one or more members selected from the group consisting of Nb, V, Ti, Zr, Hf and Ta.

12. A method of producing a part with suppressed release of sulfide gas, which comprises: processing a martensitic stainless steel of the alloy composition defined by any one of claims 7–11 by forging and/or machining to the shape of the part followed by quenching and tempering, or quenching and tempering followed by machining to the shape of the part, and applying a solution of oxidative acid to the surface of the part so as to dissolve and remove sulfides existing on the surface of the part.

* * * * *